US008534354B2

(12) United States Patent
Maidla et al.

(10) Patent No.: US 8,534,354 B2
(45) Date of Patent: Sep. 17, 2013

(54) COMPLETION STRING DEPLOYMENT IN A SUBTERRANEAN WELL

(75) Inventors: Eric E. Maidla, Sugar Land, TX (US); Marc Haci, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 370 days.

(21) Appl. No.: 12/718,423

(22) Filed: Mar. 5, 2010

(65) Prior Publication Data

US 2011/0214875 A1 Sep. 8, 2011

(51) Int. Cl.
*E21B 43/10* (2006.01)

(52) U.S. Cl.
USPC ..... 166/250.01; 166/381; 175/171

(58) Field of Classification Search
USPC ..... 166/77.1, 250.01, 380, 381; 175/171
See application file for complete search history.

(56) References Cited

U.S. PATENT DOCUMENTS

| | | | | |
|---|---|---|---|---|
| 4,787,457 | A | 11/1988 | Webster et al. | |
| 6,142,545 | A | 11/2000 | Penman et al. | |
| 6,244,345 | B1 * | 6/2001 | Helms | 166/301 |
| 6,446,725 | B2 | 9/2002 | Cabot | |
| 6,679,333 | B2 | 1/2004 | York et al. | |
| 6,796,390 | B1 * | 9/2004 | Bakker | 175/61 |
| 6,802,378 | B2 | 10/2004 | Haci et al. | |
| 6,918,453 | B2 | 7/2005 | Haci et al. | |
| 7,096,948 | B2 * | 8/2006 | Mosing et al. | 166/285 |
| 7,096,979 | B2 | 8/2006 | Haci et al. | |
| 7,290,617 | B2 | 11/2007 | Popilian et al. | |
| 7,451,826 | B2 | 11/2008 | Pietras | |
| 7,509,722 | B2 | 3/2009 | Shahin et al. | |
| 7,588,099 | B2 | 9/2009 | Kracik | |
| 7,617,866 | B2 | 11/2009 | Pietras | |
| 2004/0035581 | A1 | 2/2004 | Cavender | |
| 2004/0168799 | A1 | 9/2004 | Simonds et al. | |
| 2007/0175662 | A1 * | 8/2007 | Kracik | 175/24 |
| 2008/0066958 | A1 | 3/2008 | Haci et al. | |
| 2008/0236841 | A1 | 10/2008 | Howlett et al. | |
| 2009/0008078 | A1 | 1/2009 | Patel | |
| 2009/0139767 | A1 * | 6/2009 | Jeffryes | 175/40 |
| 2009/0266539 | A1 * | 10/2009 | Ruark et al. | 166/250.01 |
| 2010/0032170 | A1 | 2/2010 | Howett et al. | |

OTHER PUBLICATIONS

International Search Report and Written Opinion for International Application No. PCT/US2011026969 dated Aug. 26, 2011.
International Preliminary Report on Patentability for International Application No. PCT/US2011026969 dated Sep. 20, 2012.

* cited by examiner

*Primary Examiner* — Giovanna Wright
*Assistant Examiner* — Richard Alker
(74) *Attorney, Agent, or Firm* — Kimberly Ballew

(57) ABSTRACT

A method for deploying a completion string in a previously drilled borehole includes rotating the string at the surface while axially urging the assembly deeper into the borehole. This rotation is preferably only partially transferred down the completion string such that a lower portion of the string typically remains rotationally stationary with respect to the borehole. The completion string may be reciprocated upwards and downwards from the surface so as to enable the lower portion of the completion string to rotate. The completion string may alternatively be rotated back and forth, alternating between first and second rotational directions so as to maintain an applied surface torque below a predetermined threshold. The invention has been found to reduce drag between a completion assembly and the wall of a previously drilled borehole.

10 Claims, 4 Drawing Sheets

COMPLETION STRING DEPLOYMENT IN A SUBTERRANEAN WELL

RELATED APPLICATIONS

None.

FIELD OF THE INVENTION

The present invention relates generally to evaluation, completion, stimulation, and/or workovers of oil and gas wells. More particularly, the invention relates to methods for running a wellbore completion assembly into a directional and/or horizontal well.

BACKGROUND OF THE INVENTION

Drilling and completing oil and gas wells is a highly expensive undertaking since oil and gas bearing formations are generally located many thousand of feet below the surface of the earth. As is known to those of ordinary skill in the art, deviated wells are commonly utilized to improve production, reduce costs, and minimize environmental impacts. Wellbores including vertical, doglegged, and horizontal sections are now common. For example, extended reach wellbores commonly extend vertically only a few thousand feet downward from the surface but may extend many thousand feet (even tens of thousands of feet) horizontally.

Completing oil and/or gas wells requires deploying a completion assembly (also referred to herein as a completion string), for example, including a casing string or a sand screen in a previously drilled borehole. The completion assembly may also include a production combination string that can include many different types of downhole production or well stimulation devices (e.g. inflatable packers) and can be deployed in either a cased or open wellbore. In many completion applications, a casing string is lowered into the borehole under the influence of the Earth's gravitational field. In highly deviated, horizontal, and/or extended reach wellbores, deployment of the casing string can be problematic. For example, when the wellbore is highly deviated and of substantial length, the longitudinal frictional forces (referred to herein as drag) along the length of the casing become so great that the casing can become damaged or even stuck in the well.

One method that is sometimes used to deploy a casing string in a wellbore is to rotate the assembly during deployment. While rotation of the casing string tends to reduce drag, it also subjects the string to high torsional stresses. Conventional casing tends to be highly susceptible to both axial and torsional stresses. These axial and torsional stresses are known to buckle or otherwise damage completion assembly components during installation. As a result, high strength casing components (referred to in the industry as "premium joints") are required when using rotation. This adds significant expense to a conventional casing operation and is therefore undesirable for many operations. Moreover, a completion assembly commonly includes one or more tubulars having slots, screens, or other openings (for example, heavy oil applications commonly employ a string of slotted casing). These openings tend to further reduce the strength of the casing and therefore further limit the axial and/or torsional load that can be applied to the string.

One disclosed method for extended reach wells is to float the casing off the bottom of the well with a dense fluid such as drilling fluid (mud). In such operations, the casing is run into the well empty with a shoe or plug deployed on the lower end. As it moves into the mud-filled well, a buoyancy force tends to float the casing string off the bottom of the well. While the buoyancy of the casing tends to reduce drag, it can also present problems. For example, floated casing has a tendency to "kick back" (up and out) of the wellbore. This kick back can be a significant safety concern and requires that the casing be firmly held at all times while it is lowered into the wellbore.

The aforementioned drag is often significant even when the casing is floated. Those of ordinary skill in the art will appreciate that a horizontal section of a wellbore is seldom perfectly straight and often includes various peaks, valleys, twists, and turns (especially in geosteering and well twinning applications). These borehole features can significantly increase friction. Moreover, a casing string including various openings (e.g., slots) is not readily floated since the drilling mud can quickly fill the casing as it is lowered into the wellbore.

Therefore, there remains a need in the oilfield services industry for improved methods for deploying a completion string in a deviated borehole. In particular, there remains a need for deployment methods that reduce drag between the casing string and the borehole wall.

SUMMARY OF THE INVENTION

The present invention addresses the above-described need for improved methods for deploying a completion string (completion assembly) in a drilled borehole. Aspects of this invention include a method in which a completion assembly is rotated at the surface while axially urging the assembly downward (deeper) into a previously drilled borehole. This rotation is preferably only partially transferred down the completion string such that a lower portion of the string typically remains rotationally stationary with respect to the borehole. In one exemplary embodiment, an applied torque may be held at a constant value (or alternatively the rotation may be stopped) when a measured parameter reaches a predetermined threshold. The completion string may then be axially reciprocated upwards and downwards from the surface so as to enable the lower portion of the completion string to rotate in the drilled borehole. The process is typically repeated numerous times during deployment of the completion string. In another exemplary embodiment, the completion assembly may be rotated back and forth, alternating between first and second rotational directions so as to maintain an applied surface torque below a predetermined threshold. For example, the completion assembly may be rotated in the first direction until the surface torque reaches the threshold. Rotation is then reversed until the torque again reaches the threshold at which point the rotation is reversed again (and so on).

Exemplary embodiments of the present invention advantageously provide several technical advantages. In particular, the invention has been found to reduce longitudinal frictional forces (drag) between a completion assembly (completion string) and the wall of a previously drilled borehole. Reduced drag advantageously reduces stress, and therefore reduces damage imparted to the string during deployment. The method further advantageously enables sensitive components, for example, including screens and slotted liners, to be more easily deployed.

Exemplary embodiments of the invention may be further advantageous in that they tend to obviate the need to use expensive, high strength components. The invention also tends to obviate the need to include additional friction reducing components in the completion string (e.g., a swivel type device between the drill pipe and completion string or low friction stabilizers for reducing drag). The invention, therefore, tends to reduce cost and save rig time in that fewer, and less expensive, completion string components are required.

In one aspect, the present invention includes a method for deploying a wellbore completion assembly in a previously drilled borehole. The wellbore completion assembly is deployed in the previously drilled borehole and axially urged downward into the borehole from a surface location. The completion assembly is rotated from the surface and at least one parameter is measured while rotating. An applied surface torque is held at a substantially constant value when the measured parameter reaches or exceeds a predetermined threshold (in an alternative embodiment a rotary brake may be applied). The completion string is then axially reciprocated upwards and downwards from the surface while the surface torque is held at the constant value or while the rotary brake is applied).

In another aspect, the present invention includes a method for deploying a wellbore completion assembly in a previously drilled borehole. The wellbore completion assembly is deployed in the previously drilled borehole and axially urged downward into the borehole from a surface location. The completion assembly is rotated in a first direction from the surface. At least a first parameter is measured while the completion string is rotated in the first direction. The completion string is rotated in a second direction from the surface when the first parameter measured reaches or exceeds a first predetermined threshold. At least a second parameter is measured while rotating the completion assembly in the second direction. The process of rotating and measuring is repeated when the second parameter reaches or exceeds a second predetermined threshold.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiments disclosed may be readily utilized as a basis for modifying or designing other structures for carrying out the same purposes of the present invention. It should also be realize by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
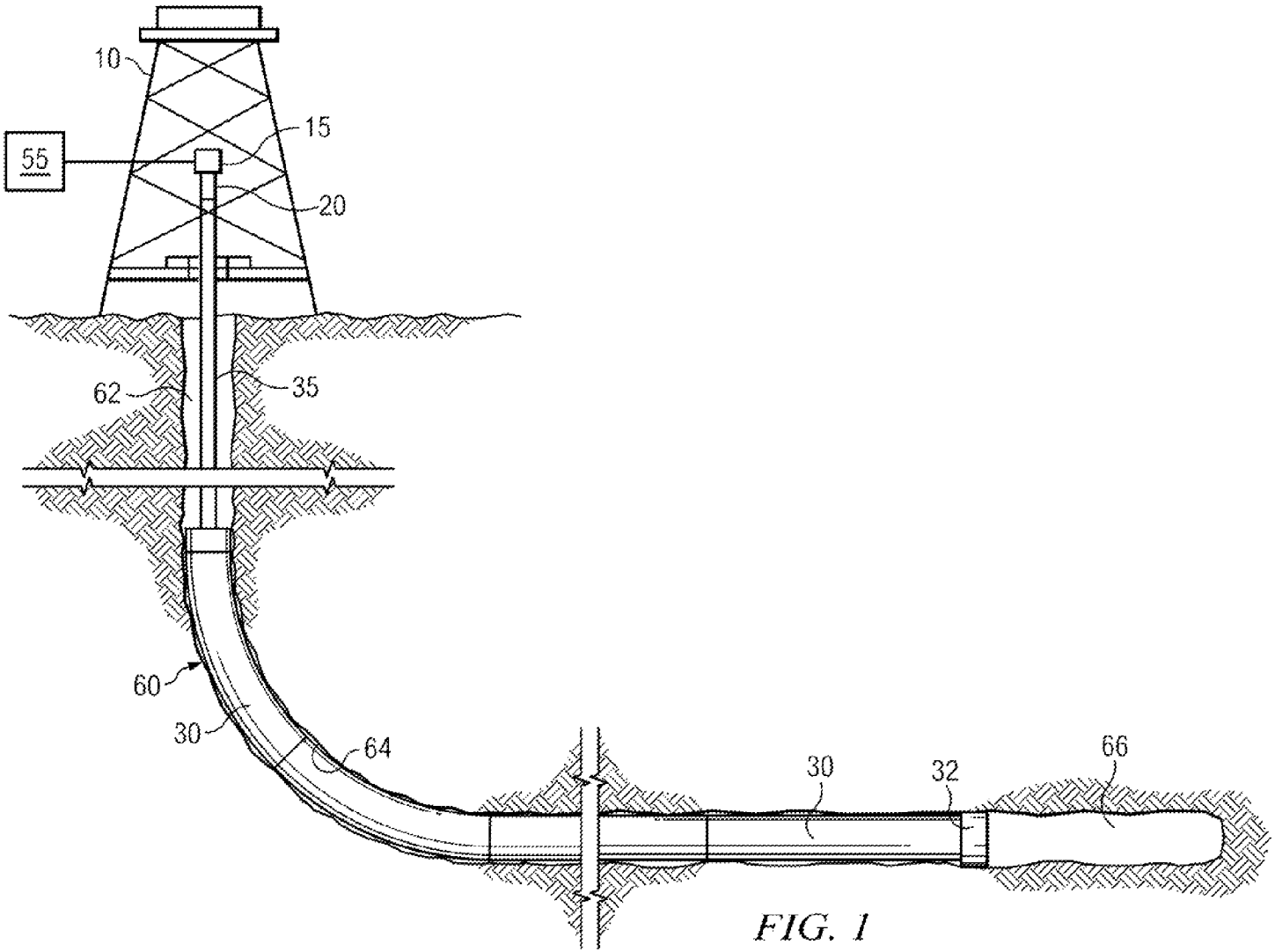
FIG. 1 depicts a drilling rig on which exemplary method embodiments in accordance with the present invention may be utilized.

FIG. 1 depicts a drilling rig 10 suitable for use with exemplary method embodiments in accordance with the present invention. In FIG. 1, a drilling platform is positioned in the vicinity of an oil or gas formation (not shown). The rig 10 includes a derrick and a hoisting apparatus for raising and lowering various assemblies, for example, completion assembly 30, which, as shown, is deployed in borehole 60. The rig typically further includes a top drive 15 (or other suitable assembly such as a rotary table) rotatably connected to the completion assembly 30. The top drive 15 may be configured to rotate the completion assembly in either direction (clockwise or counterclockwise). It will be understood that the terms completion assembly and completion string are used interchangeably herein.

In FIG. 1, borehole 60 is a deviated borehole including vertical 62, doglegged 64, and horizontal 66 sections. While the invention is not limited to such deviated borehole configurations, it will be appreciated that exemplary embodiments of the invention are particularly well suited for use with highly deviated and extended reach wells including horizontal (or nearly horizontal) sections. It will also be understood by those of ordinary skill in the art that the present invention is not limited to use with a land rig 10 as illustrated in FIG. 1. The present invention is equally well suited for use with any kind of subterranean completions operations, either offshore or onshore. The invention is not even limited to the oilfield and may also be used, for example, in under river crossing and other similar applications.

With continued reference to FIG. 1, completion assembly 30 may be coupled to the top drive 15, for example, via a section of conventional drill pipe 35. FIG. 1 further depicts one or more sensors 20 that are configured to provide measurements, for example, of the torque and axial load applied to the completion string. While these sensors 20 are depicted as being deployed in a "sub" located between drill pipe 35 and top drive 15, it will be understood that such a depiction is for convenience of illustration only. The sensors can be located at substantially any suitable rig or top drive location. While surface sensors are preferred, it will be understood that one or more of the sensors 20 may be deployed, for example, on the drill pipe 35 or even on the completion string 30. The sensors are further preferably, although not necessarily, electronically connected to a controller 55 which is configured to control the top drive 15 and therefore the rotation applied to the completion string 30.

Completion string 30 may include a casing shoe 32 deployed at a lower end of a plurality of interconnected casing tubulars (which are not shown separately). The string 30 often further includes specialized equipment or assemblies known to those of ordinary skill in the art. For example, the completion string 30 may include one or more of the following components: axially slotted tubulars, screens, sand control screens, packers, centralizers, and the like. Slotted tubulars are commonly employed, for example, in heavy oil applications such as tar sand formations. The invention is not limited in these regards.

Figure 2:
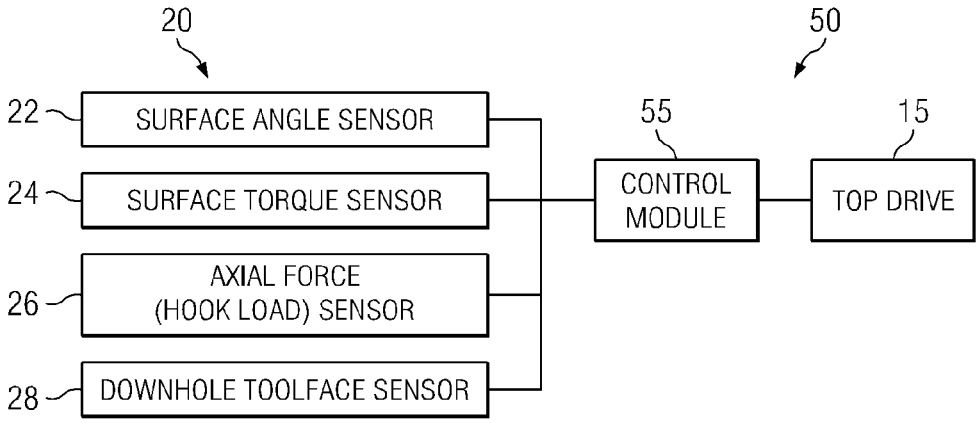
FIG. 2 depicts one exemplary embodiment of a suitable system for use in deploying a completion string in a borehole

FIG. 2 depicts one exemplary embodiment of a suitable system 50 for executing method embodiments in accordance with the present invention. In the exemplary embodiment depicted, system 50 includes the aforementioned one or more sensors 20. The system may include substantially any number of sensors 20, for example, including a surface angle sensor 22, a surface torque sensor 24, and a surface axial load (hook load) sensor 26. The system 50 may further include a downhole tool face sensor 28 (e.g., an accelerometer set and/or a magnetometer set) for measuring the tool face of a component in the completion assembly. Those of ordinary skill in the art will also understand that torque sensor 24 need not directly measure the applied torque. For example, a "torque" sensor may measure the electric current drawn by an electric motor that operates the top drive 15 or a hydraulic pressure applied to an hydraulic motor the operates the top drive 15. The torque sensor may also be implemented as a strain gage on drill pipe 35 or on the top drive shaft.

At least one of the sensors is typically deployed in electronic communication with controller 55 (which may include, for example, a conventional computer or computerized system). The controller 55 may be in further communication with top drive 15 (or some other mechanism configured to rotate the completion string) and is typically configured to control the rotation of the top drive 15. For example, in preferred embodiments of the invention, the controller may be configured to controllably rotate the top drive at low rotation rates (e.g., less than 10 rpm) while not exceeding a predetermined applied torque limit. While FIG. 2 depicts a system suitable for automated control, it will be understood that the invention is not limited in this regard. Exemplary embodiments in accordance with the invention may likewise employ manual control schemes.

Figure 3A:
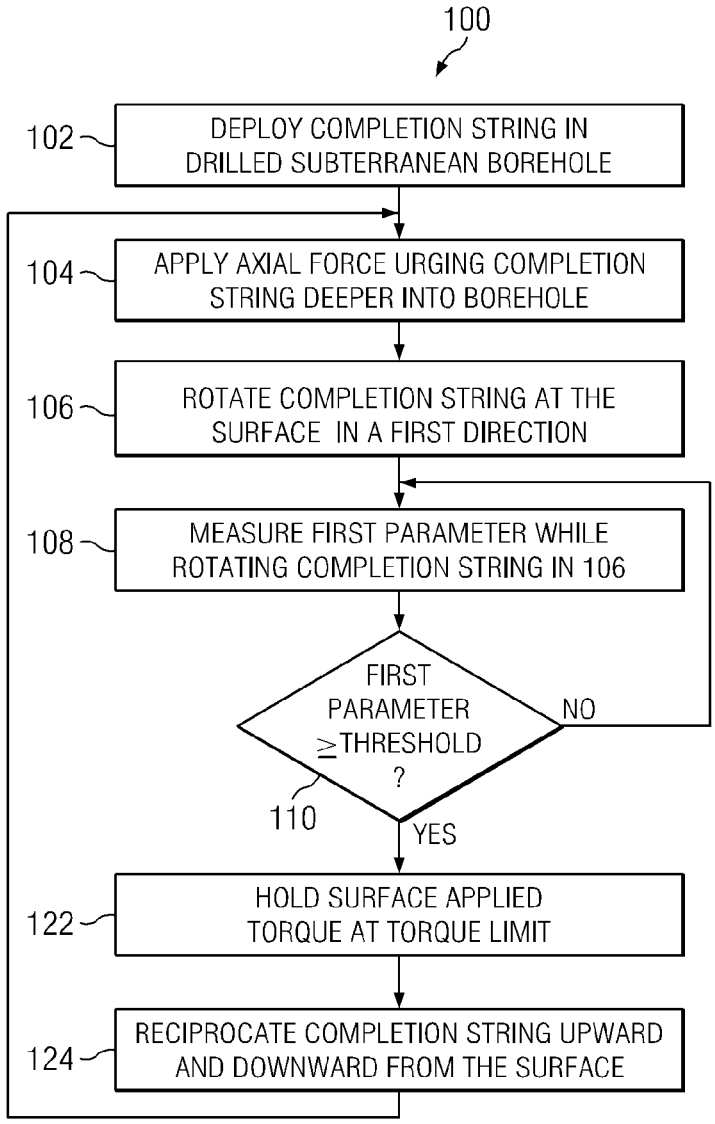
FIG. 3A depicts a flow chart of one exemplary method embodiment in accordance with the present invention.

FIG. 3A depicts one exemplary method embodiment 100 in accordance with the present invention. At 102 a suitable completion string is deployed in a previously drilled subterranean borehole. The completion string may include a conventional casing string (as depicted on FIG. 1), for example, including a plurality of casing tubulars (commonly referred to in the industry as "joints") connected end to end. A conventional completion string may alternatively and/or additionally include, for example, one or more slotted tubulars or screens. The completion string is typically connected to a length of drill pipe, which is in turn connected with the top drive (or other suitable rotary control mechanism). The invention is not limited in regard to the means by which the completion string is connected to the rotary control mechanism.

At 104 an axial force is applied to the completion string. The axial force is directed downwards into the drilled borehole and thereby urges the completion string deeper into the hole (e.g., down around a dogleg and/or further along a horizontal section). At 106 the completion string is rotated from the surface (e.g., via the top drive) in a first direction (e.g., a clockwise direction looking downward into the borehole). In one exemplary embodiment, the top drive may be accelerated to a constant rotation rate in the first direction, thereby at least partially rotating the completion string in the first direction. By partially rotating it is meant that only a portion of the completion string (typically the portion located nearer to the surface) rotates in the borehole under the influence of the applied torque. For example, rotating at the surface may be sufficient to overcome the longitudinal frictional force between the upper portion of the completion string and the borehole wall. The lower portion of the completion string may remain rotational stationary with respect to the borehole. Low rotation rates are generally preferred so as to improve the controllability of the process (e.g., to reduce the likelihood of a high torque being inadvertently applied). Preferred rotation rates are less than about 15 rpm. Most preferred rotation rates are less than about 10 rpm (e.g., about 5 rpm).

At 108 a first parameter is measured while rotating the completion string from the surface in the first direction in 106. The first parameter is preferably measured "continuously", i.e., repeatedly at some frequency, for example, at least one measurement per second (1 Hz) although lower frequencies may also be used. Such continuous measurements may be either discrete or analog and may be advantageously utilized in automated methods in accordance with the present invention. Non-continuous (or intermittent) measurements may also be utilized, for example, in manual methods.

The first parameter may include substantially any suitable parameter. For example, in a preferred embodiment of the invention, the first parameter is applied surface torque (the rotational force applied to the casing string at the surface). In other exemplary embodiments, the first parameter may include: (a) a length of time, (b) a surface angle, (c) an applied arc distance (a rotation angle multiplied by a radius), and (d) an applied energy (e.g., an applied torque multiplied by a surface angle).

The rotation in 106 is typically applied until the first parameter equals or exceeds (is greater than or equal to) a first predetermined threshold. This is depicted at 108 and 110 in which the measured first parameter is compared with the first predetermined threshold value. It will be understood by those of ordinary skill in the art that the first parameter may be readily re-defined such that the rotation in 106 is applied until the parameter is less than or equal to a threshold (e.g., by taking the inverse of the parameter). The invention is not limited in this regard. When the measured parameter is less than the threshold, the method continues to monitor the first parameter while the string is rotated at the surface (i.e., the method returns to 108 where the first parameter is measured again). When the first parameter is greater than or equal to the first predetermined threshold value, the method proceeds to 122. For example, in a preferred embodiment of the invention, the completion string is rotated at the surface in 106 until the applied torque reaches or exceeds the predetermined value.

At 122, the applied surface torque (e.g., applied via top drive 15) is held (or limited to) a substantially constant value. This constant value (or torque limit) may be the value of the applied surface torque at the time at which the first parameter exceeds the threshold in 110. For example, when the measured parameter is applied surface torque, the constant value commonly equals the threshold. When some other parameter is measured (e.g., angle or time), the constant value typically equals the surface torque value applied at the time at which the parameter first exceeds the threshold. It will be understood that application of the torque limit in 122 commonly stalls the top drive (since more torque is required to continue rotating).

At 124, the completion string is moved (reciprocated) upwards and downwards from the surface (e.g., between first and second longitudinally opposed positions) while the applied surface torque is held at the constant value. Such reciprocation is intended to reduce the frictional forces between the lower portion of the completion string and the borehole wall and to thereby cause the lower portion of the completion string to rotate in the drilled borehole in the same direction as the rotation in 106. Drilling fluid may also be circulated in the drilled borehole during this step to reduce friction and promote rotation of the lower portion of the completion assembly. At some time (e.g., after a predetermined number of upward and downward movements of the completion string), method 100 typically returns to step 104 and repeats steps 104, 106, 108, 110, 122, and 124. This process may be continued indefinitely until the completion assembly is fully deployed in the drilled borehole.

Figure 3B:
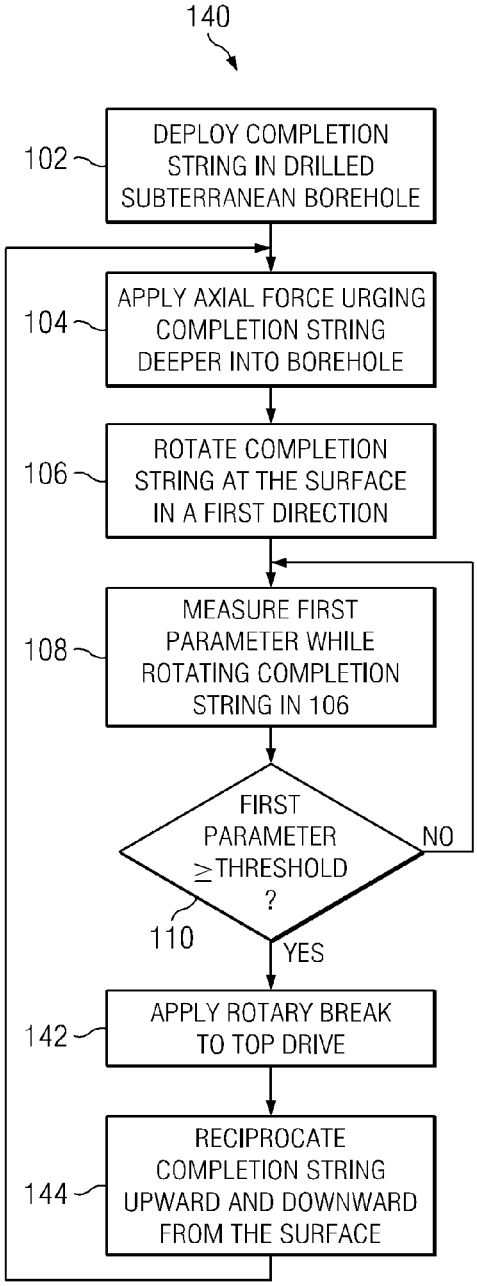
FIG. 3B depicts a flow chart of another exemplary method embodiment in accordance with the present invention.

FIG. 3B depicts an alternative method embodiment 140 in accordance with the present invention. Method embodiment 140 is similar to method 100 in that it includes steps 102 through 110 as depicted on and described above with respect to FIG. 3A. At 142, a rotary brake is applied to the top drive. Application of the brake stops the rotation and holds the top drive at a singular angular position. At 124, the completion string is moved (reciprocated) upwards and downwards from the surface (e.g., between first and second longitudinally opposed positions) as described above with respect to FIG. 3A. The reciprocation is intended to cause the lower portion of the completion assembly to rotate in the drilled borehole as also described above with respect to FIG. 3A. Drilling fluid may also be circulated in the drilled borehole during this step to reduce friction and promote rotation of the lower portion of the completion assembly. At some time (e.g., after a predetermined number of upward and downward movements of the completion string), the brake (applied at 142) is released and the method 140 returns to step 104 and repeats steps 104, 106, 108, 110, 142, and 124. This process may be continued indefinitely until the completion assembly is fully deployed in the drilled borehole.

Figure 4A:
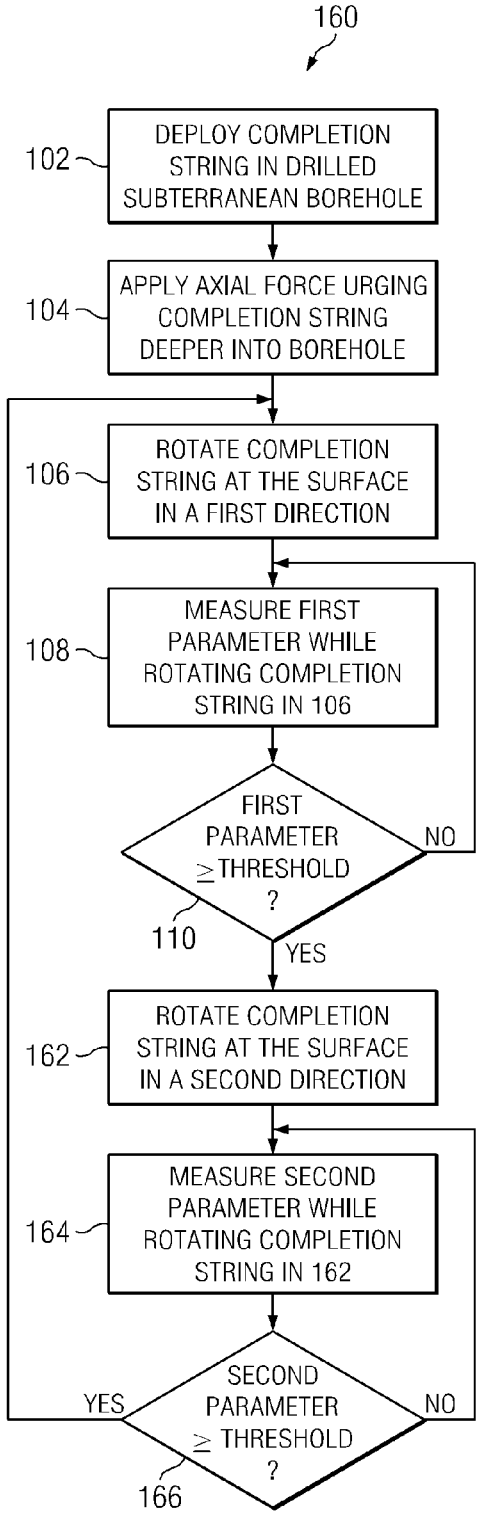
FIG. 4A depicts a flow chart of still another alternative method embodiment in accordance with the present invention.

FIG. 4A depicts another alternative method embodiment 160 in accordance with the present invention. Method embodiment 160 is also similar to method 100 in that it includes steps 102 through 110 as depicted on and described above with respect to FIG. 3A. At 162 the completion string is rotated in a second (opposite) direction when the first parameter measured in 108 is greater than or equal to the first predetermined threshold. The top drive may be rotated in the second direction, for example, by decelerating the rotation in the first direction and then accelerating rotation in the second direction to a constant rotation rate in the second direction, thereby at least partially rotating the completion string in the second direction. Low rotation rates are preferred as described above with respect to FIG. 3A.

The completion string is typically rotated in 162 until a second parameter equals or exceeds a second predetermined threshold (again, this parameter may be readily redefined such that the rotation continues until the parameter is less than or equal to the threshold). This is depicted at 164 and 166 in which the second parameter is measured and compared with the second predetermined threshold value. The second parameter is also preferably (although not necessarily) measured continuously. When the second parameter is less than the corresponding threshold, the method 160 continues to monitor the second parameter while the rotational force is applied. When the second parameter is greater than or equal to the second predetermined threshold value, the method 160 returns to 106 and repeats 106, 108, 110, 162, 164, and 166.

It will be understood that in certain embodiments, the first and second parameters may be the same parameter. For example, the first and second parameter may both include an applied surface torque, such that the method includes measuring a first applied torque in 108 and a second applied torque in 164. In such embodiments, the first and second predetermined threshold values may be equal or unequal (the invention is not limited in these regards).

The first and second parameters may also be different parameters. For example, in one exemplary embodiment, the first parameter may include applied surface torque and the second parameter may include another parameter such as rotation time or rotational angle. In such an embodiment, the completion string may be rotated in a first direction at 106 until a threshold torque is applied and then rotated in the opposite direction at 162 for a predetermined time or through a predetermined angle. The invention is, of course, not limited in these regards.

In still other embodiments of the invention, multiple parameters may be measured simultaneously at 108 and 164. These parameters may then be used in combination at 110 and 166. For example, applied torque and rotational angle may be simultaneously measured at 108, with each of these parameters being compared with a corresponding threshold at 110. In one exemplary embodiment, the method may proceed to 162 when either of the measured parameters (torque or rotational angle) is greater than or equal to corresponding threshold values. In another embodiment, the method may proceed to 162 only when both the measured parameters are greater than or equal to corresponding threshold values. In still another embodiment, the method may proceed to 162 when a combination (e.g., a product or a ratio) of the parameters is greater than a threshold value.

The predetermined threshold values for the first and second parameters may be set by a rig operator. For example, when the parameters include applied toque, the preselected torque value may be determined by calculating an expected friction between the completion string and the borehole wall. The predetermined torque value may be advantageously selected so that an upper portion of the completion string rotates in the borehole and a lower portion of the completion string remains rotationally stationary. Computer modeling techniques for making such calculations are known in the art.

Figure 4B:
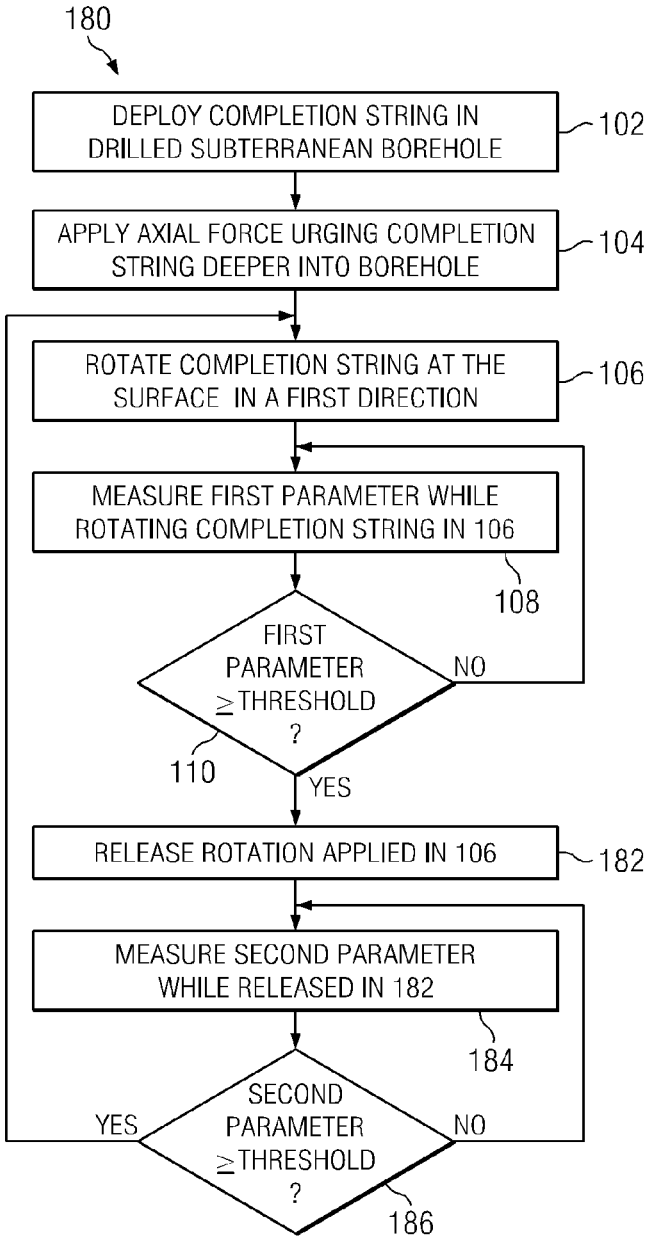
FIG. 4B depicts a flow chart of yet another exemplary method embodiment in accordance with the present invention.

FIG. 4B depicts still another alternative method embodiment 180 in accordance with the present invention. Method embodiment 180 is also similar to method 100 in that it includes steps 102 through 110 as depicted on and described above with respect to FIG. 3A. At 182 the rotational movement applied at the surface in 106 is ceased and the torque is released when the first parameter is greater than or equal to the first threshold in 110. This releasing of the torque enables the completion string to rotate back in the opposite (second) direction under the influence of the elastic energy imparted to the string at 106. Those of ordinary skill in the art will appreciate that a partial rotation of the completion string in 106 results in torsional energy being stored in the string (the string may be thought of as a torsion spring in these applications). When the torque is released in 182, the stored energy urges the upper portion of the completion string (and the top drive) to rotate in the opposite direction.

The rotational force is typically released at 182 until a second parameter equals or exceeds a second predetermined threshold. This is depicted at 184 and 186 in which the second parameter is measured and compared with the second predetermined threshold value. When the measured parameter is less than the threshold, the method continues to monitor the second parameter. When the second parameter is greater than or equal to the second predetermined threshold value, the method returns to 106 and repeats 106, 108, 110, 182, 184, and 186.

As described above with respect method 160, the first and second parameters may be the same parameter in certain embodiments of method 180. For example, the first and second parameter may include torque. Also the first and second parameter may include rotational angle, such that the method includes measuring a first rotational angle in 108 and a second rotational angle 184. The first and second parameters may also be different parameters. For example, in one exemplary embodiment, the first parameter may include applied torque and the second parameter may include another parameter such as release time or rotational angle. In such an embodiment, the completion string may be rotated in a first direction at 106 until a threshold torque is applied and then released at 182 for a predetermined time or until the top drive has rotated back through a predetermined angle. The invention is, of course, not limited in these regards.

Figure 5:
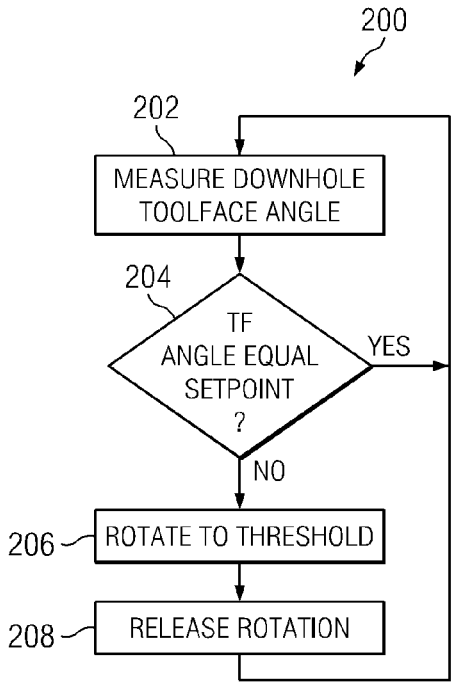
FIG. 5 depicts a flow chart of a further alternative method embodiment in accordance with the present invention.

FIG. 5 depicts a further alternative method embodiment 200 in accordance with the present invention. Method 200 may be executed as a stand alone method or in combination, for example, with methods 160 and 180 depicted on FIGS. 4A and 4B. Method 200 is typically utilized to rotate one or more components in a completion string to a predetermined angular orientation (toolface) in the drilled borehole. The method may be advantageously utilized for substantially any number of reasons. For example, method 200 may be executed after the completion string has been deployed to its final position (or close to its final position) in the borehole to rotate the completion string to a predetermined angular orientation. Method 200 may also be executed during deployment of the completion string, for example, to enable the completion string to more easily enter a lateral or to maintain a portion of the string at a predetermined angular orientation during deployment.

At 202, a downhole toolface angle may be measured, for example, using sensor 28 depicted on FIG. 2. The toolface measurement is intended to be indicative of the angular orientation of a particular component (or components) on the completion string (e.g., a window or slot in the casing). It will be understood that a change in tool face angle may likewise be measured (e.g., between first and second times). The invention is not limited in these regards. At 204, the measured toolface angle is compared with a predetermined set point. When the measured toolface angle equals the set point (or is within a predetermined range of the set point), method 200 may return, for example, to step 202 or to step 106 in method 160 or method 180. When the measured toolface angle is not equal to the set point (or is outside the predetermined range), the method proceeds to 206 at which the completion string is rotated at the surface in either the first or second direction so as to at least momentarily rotate the entire completion string. This may be accomplished, for example, by rotating at the surface to a threshold that is greater than the threshold at 110 in FIGS. 3 and 4. When this higher threshold is achieved, the rotation may be released at 208 and the method returns to 202 (or optionally to step 106 in method 160 or method 180). Method 200 may further include reciprocating the completion assembly "up and down" at the surface between first and second longitudinally spaced positions when the measured tool face angle is outside the predetermined range (or not equal to the set point).

As described above, method 200 may be utilized in combination with method 160 and 180. For example, the torque applied at the surface (e.g., in step 106) may be momentarily increased above and beyond the predetermined threshold in 110 (FIGS. 4A and 4B) so as to momentarily rotate the full length of the completion string. Such full rotation may be advantageous (or even necessary) at certain times during the deployment operation. For example, a casing shoe can become stuck (or jammed) when entering a lateral section of a drilled borehole (referred to in the art as a "lateral"). Momentarily rotating the shoe to a different angular orientation often enables the shoe to smoothly enter the lateral section.

Although the present invention and its advantages have been described in detail, it should be understood that various changes, substitutions and alternations can be made herein without departing from the spirit and scope of the invention as defined by the appended claims.

We claim:

1. A method for deploying a wellbore completion assembly in a previously drilled borehole, the method comprising:

(a) deploying the wellbore completion assembly in the previously drilled borehole;

(b) axially urging the completion assembly downward into the borehole from a surface location;

(c) rotating the completion assembly from the surface location;

(d) measuring an applied surface torque while rotating in (c);

(e) holding the applied surface torque to a substantially constant value when the applied surface torque reaches or exceeds a predetermined threshold;

(f) axially reciprocating the completion string upwards and downwards from the surface location while the applied torque is held at the constant value in (e).

2. The method of claim 1, further comprising (g) repeating (b), (c), (d), (e), and (f) a plurality of times.

3. The method of claim 1, wherein:

the predetermined threshold is selected so that at least a lower portion of the completion assembly remains substantially rotationally stationary in (c), (d), and (e); and said reciprocation in (f) causes the lower portion of the completion assembly to rotate in the drilled borehole in the same direction as said rotation in (c).

4. The method of claim 1, further comprising:

(g) circulating drilling fluid downward through the completion assembly while axially reciprocating in (f).

5. A method for deploying a wellbore completion assembly in a previously drilled borehole, the method comprising:

(a) deploying the wellbore completion assembly in the previously drilled borehole;

(b) axially urging the completion assembly downward into the borehole from a surface location;

(c) rotating the completion assembly from the surface location;

(d) measuring an applied surface torque while rotating in (c);

(e) applying a rotary brake at the surface location when the applied surface torque measured in (d) reaches or exceeds a predetermined threshold, the rotary brake configured to stop said surface rotation;

(f) axially reciprocating the completion string upwards and downwards from the surface location while the rotary brake is applied in (e).

6. The method of claim 5, further comprising (g) repeating (b), (c), (d), (e), and (f) a plurality of times.

7. The method of claim 5, wherein:

the predetermined threshold is selected so that at least a lower portion of the completion assembly remains substantially rotationally stationary in (c), (d), and (e); and said reciprocation in (f) causes the lower portion of the completion assembly to rotate in the drilled borehole in the same direction as said rotation in (c).

8. The method of claim 5, further comprising:

(g) circulating drilling fluid downward through the completion assembly while axially reciprocating in (f).

9. A method for changing a toolface angle of at least one portion of a completion assembly, the method comprising:

(a) deploying the completion assembly in a previously drilled borehole;

(b) measuring a downhole toolface angle, the toolface angle being indicative of an angular orientation of the at least one portion of the completion assembly;

(c) rotating the completion assembly in a first direction from a surface location when the toolface angle acquired in (b) is outside a predetermined range of toolface angles;

(d) measuring an applied surface torque while rotating in (c);

(e) releasing the rotation when the applied surface torque is greater than or equal to a predetermined threshold, the predetermined threshold being selected so that a lower portion of the completion assembly remains substantially rotationally stationary in (c) and (d); and (f) reciprocating the completion assembly between first and second longitudinally spaced positions when the tool face angle measured in (b) is outside the predetermined range of toolface angles, wherein said reciprocation causes a lower portion of the completion assembly to rotate in the drilled borehole in the same direction as said rotation in (c).

10. The method of claim 9, further comprising:

(g) circulating drilling fluid downward through the completion assembly while reciprocating in (f).

* * * * *